US005334125A

United States Patent [19]

Vähäpesola

[11] Patent Number: 5,334,125

[45] Date of Patent: Aug. 2, 1994

[54] MARTENSITE ROLL

[75] Inventor: Jari Vähäpesola, Muurame, Finland

[73] Assignee: Valmet Paper Machinery Inc., Finland

[21] Appl. No.: 61,303

[22] Filed: May 13, 1993

Related U.S. Application Data

[63] Continuation of Ser. No. 854,334, Mar. 19, 1992, abandoned.

[30] Foreign Application Priority Data

Mar. 20, 1991 [FI] Finland ..... 911360

[51] Int. Cl.[5] ..... B21B 31/08

[52] U.S. Cl. ..... 492/58; 492/54

[58] Field of Search ..... 492/54, 58

[56] References Cited

U.S. PATENT DOCUMENTS

| | | | |
|---|---|---|---|
| 3,623,850 | 11/1971 | Horvath, Jr., et al. | 196.1/29 |
| 3,997,370 | 12/1976 | Horvath, Jr. et al. | 29/132 X |
| 4,000,011 | 12/1976 | Sato et al. | 148/4 |
| 4,452,647 | 6/1984 | Sailas | 29/132 X |
| 4,546,527 | 10/1985 | Fukuda et al. | 29/132 |
| 4,548,653 | 10/1985 | Booquet et al. | 29/132 X |
| 4,721,153 | 1/1988 | Sano et al. | 29/132 X |
| 4,771,524 | 9/1988 | Barbezat et al. | 29/132 |
| 4,823,451 | 4/1989 | Terrasse et al. | 29/132 X |

FOREIGN PATENT DOCUMENTS

| | | |
|---|---|---|
| 1179721 | 10/1964 | Fed. Rep. of Germany . |
| 2013728 | 10/1970 | Fed. Rep. of Germany . |
| 3640131 | 12/1989 | Fed. Rep. of Germany . |
| 62009 | 11/1982 | Finland . |
| 885540 | 6/1989 | Finland . |
| 360701 | 4/1962 | Switzerland . |

OTHER PUBLICATIONS

Paperin Valmistus (Paper Making), part 2, Turku, 1983, p. 734.

Soviet Inventions Illustrated, Section Ch, Week 8408, Apr. 4, 1984, Derwent Publications Ltd., London, GB; Class M, p. 24, AN 84-047526/08 & SU-A-1011 709 (Heavy Transport MAC), Apr. 15, 1982.

Metal Science and Heat Treatment, vol. 25, No. 3/4, 1983, New York, pp. 281-283; A. F. Malyi et al.: "Effect of tin on the structure and properties of high-strength cast iron after induction hardening".

*Primary Examiner*—Timothy V. Eley

*Attorney, Agent, or Firm*—Steinberg, Raskin & Davidson

[57] ABSTRACT

The invention is related to a process for the manufacture of a roll, in particular of a calender roll for a paper machine. In the process, the mantle of the roll is cast or cast and heat-treated and, in the next step, the roll mantle is machined. In the process, the surface layer of the cast-iron roll mantle is hardened and tempered so that, in the surface layer of the roll mantle, a temper-martensitic structure is produced. The roll mantle is then subjected to finishing machining in a manner known in the art. The invention is also related to a roll, in particular a calender roll for a paper machine, which roll is provided with a cast-iron mantle. The surface layer of the roll mantle is hardened and tempered so that the surface layer of the roll mantle is temper-martensitic.

16 Claims, 2 Drawing Sheets

MARTENSITE ROLL

This is a continuation of application Ser. No. 07/854,334, filed Mar. 19, 1992 now abandoned.

FIELD OF THE INVENTION

The present invention is related to a process for the manufacture of a roll, in particular of a calender roll for a paper machine, in which process the mantle of the roll is cast or cast and heat-treated and, in the next step, the roll mantle is machined.

The present invention is further related to a roll, in particular a calender roll for a paper machine, the roll being provided with a cast-iron mantle.

BACKGROUND OF THE INVENTION

Traditionally, chilled-iron roll mantles have been used as the roll mantle of paper machine rolls, especially of calender rolls. These roll mantles are manufactured by casting grey cast iron or alloys of the same into a chill mould, whereby, by the effect of the chill mould, the outer face of the cast piece is cooled rapidly and becomes graphite-free white iron. The structure of white iron consists of hard iron carbides and of perlite. The white irons are hard, highly wear-resistant, and hard to machine.

A drawback of chilled-iron roll mantles is impact brittleness resulting from the material as well as sensitivity to sudden changes in temperature, for which reason it has been necessary to limit their use in applications in which the temperatures change. Moreover, owing to the process of manufacture, i.e. chill casting, the hard white layer becomes uneven, which results in a form error in the roll and in uneven distribution of temperature when the operating temperature rises. Owing to the carbides-containing microstructure of the surface layer, the wear of the roll face is uneven, which can be seen in the paper and which also necessitates re-grinding of the roll at intervals of about 6 months.

Also, the service life of the chill molds used for the casting is limited, and their cost of manufacture is high. Moreover, since several different kinds of chill molds are needed, high sums of capital are bound in them.

Moreover, owing to the high hardness of white iron, the machining of chilled-iron roll mantles is very difficult, and therefore the costs of manufacture of the rolls become high.

As is well known, attempts have been made to replace mantles of chilled-iron rolls by roll mantles of steel, in which the temperature limitations of the chilled-iron rolls do not occur.

Chilled-iron mantles cannot be used at high temperatures, e.g., of about 250° C., and, moreover, when such mantles are used, strict limits are imposed on the rate of cooling/heating, e.g., from about 0.5° to about 2° C. per minute, and the difference in temperature between the inner face and the outer face of the roll must never be higher than from about 30° to about 50° C.

Unless the above limitations are complied with, thermal shock will cause damage to the chilled-iron rolls.

When steel mantles are used, these limitations of temperature do not occur, but other problems occur. For example, doctoring causes problems, because doctoring is considerably more precise, and the doctor is worn extensively when steel mantles are used. Moreover, the mantle of a steel roll is polished during operation, and the adhesion of paper to the roll is increased, with resulting problems in the threading of the web. Also, the ability of steel to attenuate oscillations is lower than that of cast irons.

From the prior art, such solutions are also known for roll mantles in which the surface of a cast-iron roll mantle has been re-melted while thereby producing white iron in the surface layer, i.e. the objective being to provide a process substituted for chill cast, whereby a microstructure similar to chilled-iron roll-mantles is produced.

One such process is described in the U.S. Pat. No. 4,452,647, wherein a process and a device are described for the manufacture of hard-faced cast-iron pieces, in particular of rolls such as rolls for steel industry or paper calendering rolls, as well as a roll, cylinder or equivalent manufactured by means of the process. According to this reference, the cast pieces, such as rolls and cylinders, are cast in sand or in an equivalent way so that, in connection with the solidification, a substantially crystal structure of grey cast iron is produced in them and that, after this stage, a re-melting treatment is carried out by making use of an electron jet or jets to produce a cast hard at the surface. Thus, in this prior art method, a treatment of re-melting of the surface is employed, which is carried out after the work piece had been machined close to the ultimate dimensions, the process of surface-treatment being an electron jet or-jets so as to produce a heating effect that can be controlled and machined precisely.

A second prior art solution in which the surface is treated by means of the electron-jet melting process to produce a hardened cementite-carbide surface layer is described in the U.S. Pat. No. 4,000,011.

A further prior art solution based on re-melting of the surface is described in DE Patent No. 3,640,131, which discloses a mantle that has a hard mantle face and a process for the manufacture of a roll with a hard mantle face in particular for paper machines, which roll is made of cast iron that has been cast in a sand mold and, after rapid cooling, on the roll, an outer carbides-containing layer is produced together with a grey core zone. In this prior art solution, the cast roll is pre-heated to temperatures of about 400° to about 600° C., and the pre-heated surface layer is heated rapidly beyond the temperature of the liquid successively until the desired local melt layer is reached, and this melt layer is cooled rapidly to produce a carbides-containing zone. Finally, the whole roll is cooled to the ambient temperature.

In all of the prior art solutions described above, attempts have been made to provide a carbides-containing microstructure in the surface layer of the roll mantle, in which structure particles of iron carbides, i.e. cementite, are present. These iron carbides are very hard, and, when the roll is used, the roll face is worn around the carbides, and the carbides remain on the surface as outwardly projecting peaks. The flaw produced by these peaks can also be noticed in the papers produced.

In the prior art solutions, in connection with the rolls that are heated, problems have also been caused by the variations in the shape of the roll mantle when the temperature changes. In particular when the structure of the roll mantle consists of two different materials, for example when the inner part is made of flake-graphite cast iron and when the mantle surface is made of white iron after chill cast, changes in temperature result in problems, because the properties of thermal expansion and thermal conductivity of these different layer are different and, moreover, the thickness of the layer varies. The variations in shape and dimensions of the roll mantle are especially problematic, because the paper quality is deteriorated.

OBJECTS AND SUMMARY OF THE INVENTION

An object of the invention is to provide a process for the manufacture of a roll in which the problems and drawbacks of the prior art processes of manufacture do not occur and by whose means a roll is provided whose properties are better than those of prior art rolls, in particular a roll that is suitable for use at higher temperatures without particular limitations of use.

A further object of the invention is to provide a roll whose manufacture is easier and simpler and therefore also more economical for paper machine applications, in particular for calendering, than previous methods.

In view of achieving the objects stated above, those that will come out later, and others, in the process in accordance with the invention, the surface layer of the cast-iron roll mantle is hardened and tempered so that, in the surface layer of the roll mantle, a temper-martensitic structure is produced, and that, in a way in itself known, the roll mantle is subjected to finishing, machining.

Further, the present invention is related to a roll mantle having a surface layer which hardened and tempered so that the surface layer of the roll mantle is temper-martensitic.

According to a preferred embodiment of the invention, when a spheroidal graphite cast iron of higher strength and tenacity is used and when the face of the roll mantle is surface-hardened. e.g. by flame hardening or induction hardening, a temper-martensitic structure is achieved which is harder than the prior art chilled-iron roll mantle. This temper-martensitic structure has improved wear resistance, and more uniform wear because of a favorable microstructure, so that the interval of grinding of the roll is increased substantially.

Owing to the basic material of higher tenacity and strength, the roll in accordance with the invention is not sensitive even to high changes in temperature, and deformations are not produced in the roll even at high changes in temperature, for, by means of the surface hardening, a highly uniform hardened layer is obtained on the roll mantles.

Moreover, the work piece can be machined to its ultimate dimensions before hardening, so that the cost of machining of the roll is lowered significantly.

A further advantage of the process in accordance with the invention is the roll mantle may be re-hardened after the hard layer has been ground off.

The roll in accordance with the invention, which as a hard-faced roll mantle, which is cast out of a cast iron alloyed suitably in view of the hardening, and whose face has been hardened after machining, whereby a temper-martensitic microstructure is formed in the surface, is favorable in the calendering of paper because of its fine particle structure.

The intervals of grinding of the rolls in accordance with the invention become longer in comparison to prior art rolls, because of higher hardness and better resistance to wear of the face (e.g., as compared with chilled-iron rolls).

In a roll in accordance with the invention, high operating temperatures do not cause deformations, because, in principle, the roll mantle is made of one and the same material. The surface structure of the roll in accordance with the invention. i.e. the temper-martensitic microstructure, is worn uniformly, and no peak points distinguishable from the surface remain in it as a result of wear, whereby the quality of paper that is achieved is better.

With respect to its strength value, rigidity, and tenacity, the spheroidal graphite cast iron, which is used in a roll in accordance with a preferred embodiment of the invention, is a material that has better properties than the properties of flake graphite cast iron, which is used, as a rule, in chill casting.

An advantage of the roll in accordance with the invention, as compared with the prior art rolls based on steel mantle, is the lubricating effect of the graphite present as mixed in the temper-martensite in the roll mantle. Accordingly, the wear of a doctor is not extensive with the roll in accordance with the invention, as it is in the case of steel mantles.

The most important advantages of the roll in accordance with the invention, which has a mantle of cast iron, as compared with a chilled-iron mantle, include its fine and uniform microstructure; its uniform, hard surface layer; its being formed of a homogeneous material and, consequently, having smaller deformations and being more uniform; not being sensitive to changes in temperature; having better resistance to wear; having higher tensile strength; having higher impact durability; and having higher rigidity.

BRIEF DESCRIPTION OF THE DRAWINGS

The following drawings are illustrative of embodiments of the invention and are not meant to limit the scope of the invention as encompassed by the claims:

DETAILED DESCRIPTION

Figure 1:
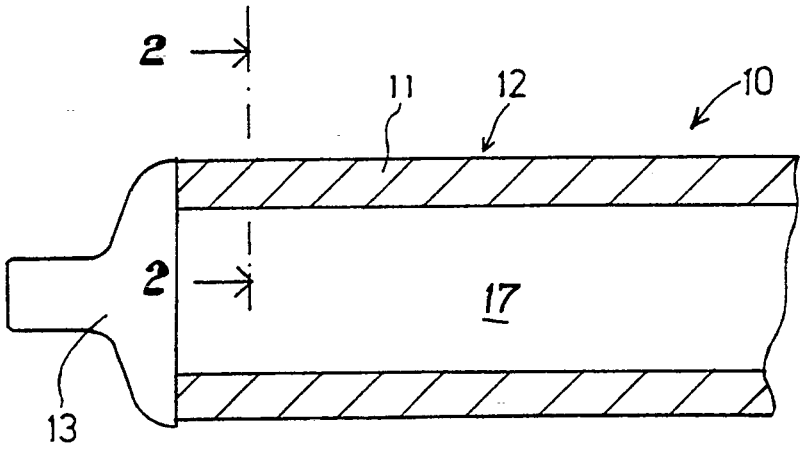
FIG. 1 is a schematic illustration of a roll.

The roll that is shown schematically in FIG. 1 is denoted with the reference numeral 10. The roll 10 comprises a roll mantle 11 and axle journals 13. The face of the roll mantle 11 is denoted with the reference numeral 12. The roll 10 shown in FIG. 1 is just a simple exemplifying embodiment. The roll mantle 11 in accordance with the invention is, of course, also suitable for use in much more complicated rolls. The inside of the roll 10 may comprise a hollow roll core 17.

Figure 2:
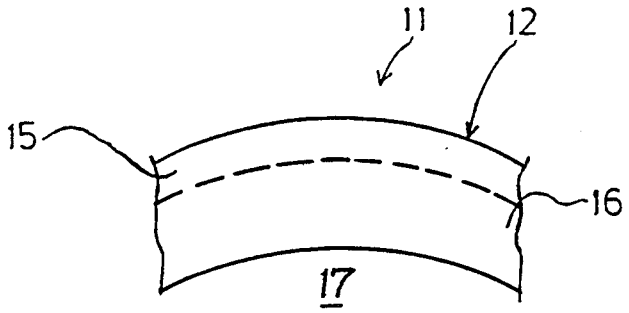
FIG. 2 is a schematic sectional view taken along the line A—A in FIG. 1.

FIG. 2 is a sectional view taken along the line 2—2 in FIG. 1. The outer face 12 of the roll mantle 11 is hard because of the surface-hardened layer 15. The inner part of the roll mantle 11 is denoted with the reference numeral 16.

In the process according to the invention, first the roll mantle 11 is cast so that a fully perlitic or ferritic-perlitic microstructure is produced which is at least 60-percent perlitic. The material has been alloyed, e.g., so that C about is 3.0 to about 3.8%, Si is about 1.5 to about 3.0%, Mn is about 0.5 to about 0.9% P is less than 0.05%, and S is less than 0.02%. As further allowing agents, Cr, Ni, Cu, Mg, Mo, Sn, and/or Al are used.

Thereafter, the cast roll mantle blank 11 is subjected to machining. The machined roll mantle 11 is surface-hardened, and before the surface hardening, if necessary, pre-heating is carried out. The surface hardening is carried out preferably as induction hardening or flame hardening.

Thereafter, the roll mantle 11 is tempered in order that the surface should obtain a temper-martensitic structure. The inner part 16 of the roll mantle has a perlitic or ferritic-perlitic structure. The tempering temperature is chosen in accordance with the future operating temperature of the roll 10.

Thereafter, the necessary finishing-grinding is carried out.

The roll mantle 11 can also be manufactured so that, after the casting, heat treatment may be carried out to produce a perlitic structure. Thereafter, stress-relieving annealing is carried out. After machining and surface hardening, preferably induction or flame hardening, the roll mantle 11 is complete except for finishing grinding.

In the process of the invention, the surface hardening is carried out preferably as induction hardening or flame hardening. Both of these methods are thermal surface-hardening methods, i.e. methods based on a heat effect, wherein the surface is heated rapidly for a short time and often locally to a hardening temperature suitable for the austenitic range, after which it is quenched before the interior has had time to be transformed to austenite. In flame hardening, the face is heated by means of a gas flame, and tile quenching takes place usually by means of a water jet that follows after tile flame. In induction hardening, at a depth of effect of the electric induction field, which is produced by means of an induction coil, eddy currents are formed in the steel or cast iron, which currents heat the piece internally.

After heating, quenching is carried out, e.g., by means of a water jet.

Figure 3:
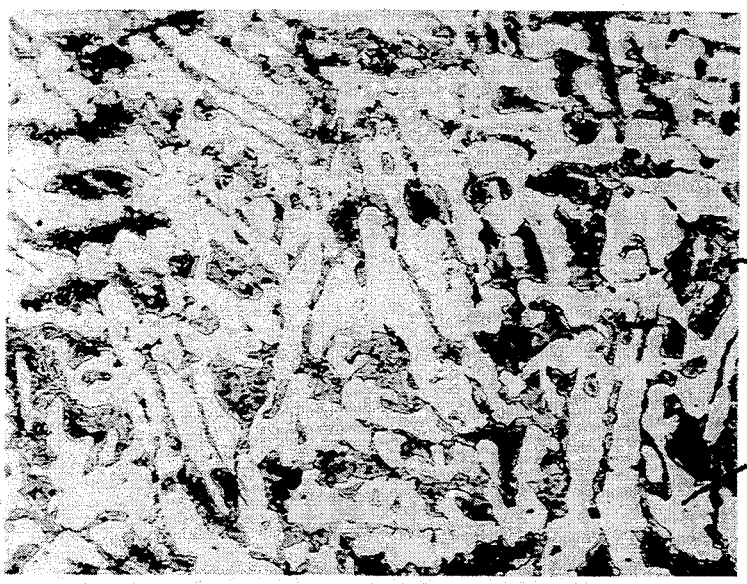
FIG. 3 shows the microstructure of the surface of the roll mantle of a prior art chilled-iron roll as a 200-fold enlargement.

FIG. 3 shows the microstructure of the surface of a prior art chill-cast roll mantle as a 200-fold enlargement. In the figure, cementite is seen on a perlite base. Cementite is denoted with the reference S and perlite with tile reference P. Cementite S, i.e. iron carbides $Fe_3C$, is hard, and when the roll face is worn in operation in the areas of perlite P, the cementites S remain in the face as projections. The hardness of the surface layer of white iron on such a chill-cast roll mantle is about 550 to about 630 HV. The variation in the thickness of the surface layer is about from 5 to about 25 mm.

Figure 4:
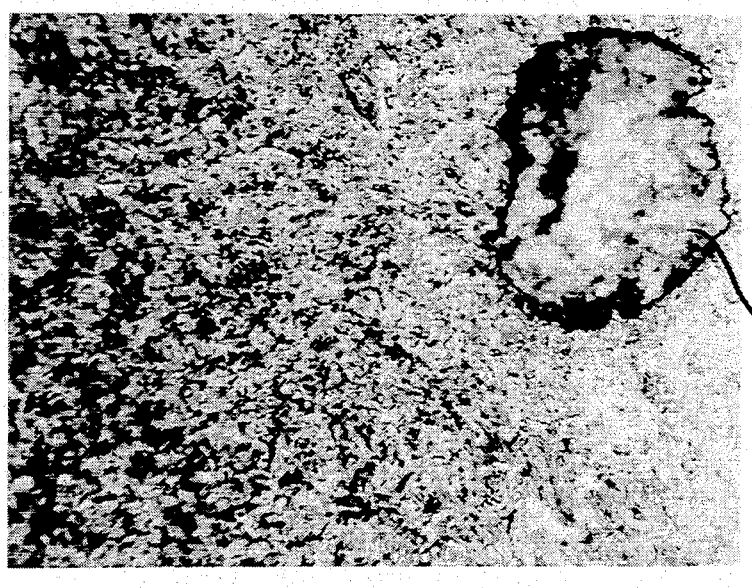
FIG. 4 shows a martensitic microstructure as a 500-fold enlargement.

FIG. 4 shows a temper-martensitic structure of the present invention as a 500-fold enlargement, said structure consisting of lens-shaped or needle-shaped crystals. FIG. 4 also shows a graphite nodule.

Figure 5:
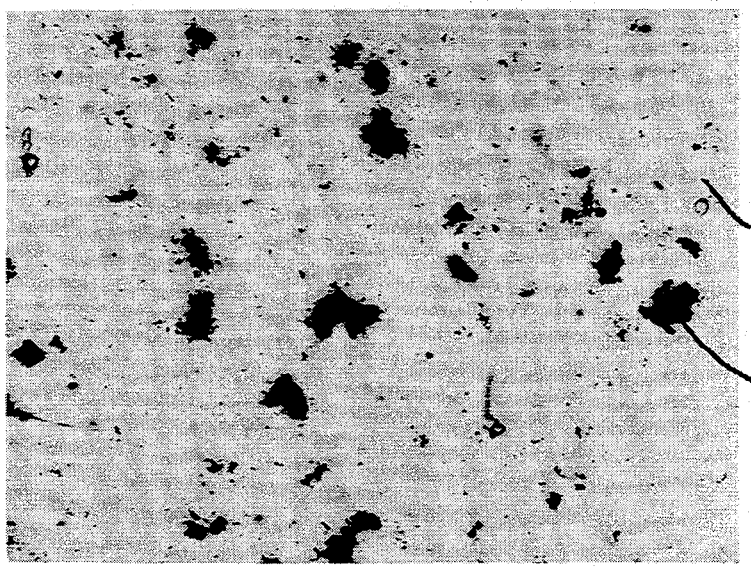
FIG. 5 shows a microstructure with graphite nodules on a martensitic base as a 200-fold enlargement.

FIG. 5 shows a hardened face with graphite nodules on a martensite base, such a base being provided on the roll in accordance with the invention,. Martensite is denoted with the reference M. In martensite M, no particle interfaces or equivalent are seen. The graphite nodules are denoted with the reference G. The scale of enlargement in FIG. 3 is 200-fold. In particular, the uniformity of the martensite structure should be noticed. The hardness of such a temper-martensitic structure is about 680 to about 720 HV, and the thickness variation of the surface-hardened layer less than 0.5 mm.

In the following table, the properties of a prior art chilled-iron roll mantle and of the mantle of a surface-hardened roll in accordance with the invention, in this particular case of an induction-hardened spheroidal graphite cast iron roll, are compared.

TABLE

| | CHILLED IRON SURFACE/ INTERIOR | INDUCTION-HARDENED SPHEROIDAL GRAPHITE CAST IRON |
|---|---|---|
| SURFACE HARDNESS (HV) | 550 to 630 | 680 to 720 |
| HARD LAYER (mm) | 6 to 15 | 8 to 10 |
| THICKNESS VARIATION IN HARD LAYER (mm) | <25 | <0.5 |
| DENSITY (kg/dm$^3$) | 7.7/7.1 | 7.3 |
| THERMAL CONDUCTIVITY (W/m °C.) | 20 to 28/ 55 to 62 | 30 |
| THERMAL EXPANSION COEFFICIENT (1/°C. $10^{-6}$) | 8.4/10.5 | 10 |
| COEFFICIENT OF ELASTICITY (kN/mm$^2$) | 175/100 | 175 |
| BREAKING STRENGTH (N/mm$^2$) | 120 to 200/ 100 to 140 | 650 |
| ELONGATION AT BREAK (%) | 0 | 1 |
| IMPACT DUCTILITY (J/cm$^2$) | 2 | 7 |

The material of the mantle 11 of the roll in accordance with the invention is primarily comprised of one and the same material, cast iron. The surface layer 15 of the roll is temper-martensitic after the surface hardening, and the interior part 16 is at least 60-percent perlitic. The thickness of the surface layer 15 is from about 5 to about 30 mm, preferably from about 8 to about 10 mm. The hardness of the surface layer 15 of the roll mantle is from about 680 to about 720 HV, and the hardness of the interior part is from about 200 to about 300 HB. The roll 10 in accordance with the invention is suitable for use at temperatures of 250° C. without particular limitations of use.

The examples provided above are not meant to be exclusive. Many other variations of the present invention would be obvious to those skilled in the art, and are contemplated to be within the scope of the appended claims.

What is claimed is:

1. A roll for use in a paper machine, said roll having a cast-iron roll mantle, an outer surface of said roll mantle being hardened and tempered such that it has a homogeneous, fine and uniform microstructure of martensite.

2. The roll of claim 1, wherein said roll mantle is made of spheroidal graphite cast iron and comprises from about 3.0 to about 3.8% C, from about 1.5 to about 3.0% Si, from about 0.5 to about 0.9% Mn, ≦0.05% P and ≦0.02% S.

3. The roll of claim 2, wherein said roll mantle comprises an additional alloying agent selected from a group consisting of Cr, Ni, Cu, Mg, Mo, Sn, Al, and mixtures of any of the foregoing.

4. The roll of claim 1, wherein an interior portion of said roll mantle is at least 60% perlitic.

5. The roll of claim 4, wherein said outer surface layer of said roll mantle has a thickness from about 5 to about 30 mm.

6. The roll of claim 5, wherein said outer surface has a hardness from about 680 to about 720 HV.

7. The roll of claim 4, wherein said interior portion of said roll mantle has a hardness from about 200 to about 300 HB.

8. The roll of claim 1, wherein said outer surface of said roll mantle has a thickness from about 8 to about 10 mm.

9. The roll of claim 1, wherein said roll mantle is flame-hardened or induction-hardened.

10. The roll of claim 1, wherein said outer surface has a substantially uniform thickness.

11. The roll of claim 1, wherein an interior of said roll mantle comprises a hollow roll core.

12. The roll of claim 1 wherein said roll is a calendar roll.

13. A roll for use in a paper machine, comprising a roll having a cast-iron cylindrical roll mantle having a homogeneous, fine and uniform microstructure and a hollow roll core, axle journals located on opposite ends of said roll mantle, and an outer surface of said roll mantle having a thickness from about 8 mm to about 10 mm and having a homogeneous, fine and uniform microstructure of martensite.

14. The roll of claim 13, wherein an interior portion of said roll mantle is made of spheroidal graphite cast iron and comprises from about 3.0 to about 3.8% C, from about 1.5 to about 3.0% Si, from about 0.5 to about 0.9% Mn, $\leqq$0.05% P, and $\leqq$0.02% S.

15. The roll of claim 14, wherein said roll mantle comprises an additional alloying agent selected from the group consisting of Cr, Ni, Cu, Mg, Mo, Sn, Al, and mixtures of any of the foregoing.

16. The roll of claim 15, wherein said interior portion of said roll mantle is at least 60% perlitic.

* * * * *